US005771723A

United States Patent [19]

Itoh

[11] Patent Number: 5,771,723

[45] Date of Patent: Jun. 30, 1998

[54] KEY CYLINDER DEVICE

[75] Inventor: Masahiko Itoh, Toyota, Japan

[73] Assignee: Toyota Jidosha Kabushiki Kaisha, Toyota, Japan

[21] Appl. No.: 610,062

[22] Filed: Feb. 29, 1996

[30] Foreign Application Priority Data

Mar. 24, 1995 [JP] Japan ..... 7-066433

[51] Int. Cl.[6] ..... E05B 27/00

[52] U.S. Cl. ..... 70/360; 70/422; 70/379 R; 70/416; 292/DIG. 37; 292/DIG. 62

[58] Field of Search ..... 292/DIG. 37, DIG. 62, 292/DIG. 27; 70/422, 360, 367, 379 R, 379 A, 416, 369, 115, 117, 472, 218, 220, 221

[56] References Cited

U.S. PATENT DOCUMENTS

| | | | |
|---|---|---|---|
| 2,059,479 | 11/1936 | North | 292/DIG. 37 |
| 2,221,095 | 11/1940 | Jacobi | 292/DIG. 37 |
| 2,357,004 | 8/1944 | Jacobi | 70/367 |
| 2,437,299 | 3/1948 | Jacobi | 292/DIG. 37 |
| 2,570,556 | 10/1951 | Jacobi | 70/379 R |
| 2,587,583 | 3/1952 | Allen et al. | 292/DIG. 27 |
| 2,687,637 | 8/1954 | Jacobi | 70/379 R |
| 3,304,755 | 2/1967 | Johnstone | 70/379 R |
| 3,868,836 | 3/1975 | La Roche . | |
| 3,964,280 | 6/1976 | Kelton | 70/360 |
| 4,073,170 | 2/1978 | Miyabayashi et al. | 292/DIG. 37 |

FOREIGN PATENT DOCUMENTS

| | | | |
|---|---|---|---|
| 1906953 | 8/1970 | Germany | 292/DIG. 37 |
| 55-152264 | 4/1954 | Japan . | |
| 62-014064 | 1/1987 | Japan . | |
| 812565 | 4/1959 | United Kingdom . | |
| 898228 | 6/1962 | United Kingdom . | |

*Primary Examiner*—Darnell M. Boucher
*Attorney, Agent, or Firm*—Cushman Darby & Cushman IP Group of Pillsbury Madison & Sutro LLP

[57] ABSTRACT

A key cylinder device in which, in a locked state, a lock-releasing mechanism is provided so as not to operate even if a cylinder case swings. When a first lever rotates in a counterclockwise direction with respect to the cylinder case, a shaft provided on a second lever extends from a side surface of the second lever and engages with a third lever to move a rod attached to the third lever in a lock-releasing direction. Further, when the first lever does not move relatively with respect to the cylinder case, even if the cylinder case swings, the shaft does not extend from the side surface of the second lever and does not engage with the third lever. For this reason, there is no possibility that the rod attached to the third lever move in the lock-releasing direction.

20 Claims, 15 Drawing Sheets

12
10
12A
20
20A
14
16D
16A
22B
12B
12C
22A
16C
22
16
16B
30B
30A
24C
32A
34
24
36
36B
30
24A
32
26
28
24B
42
36A
38
18
40

KEY CYLINDER DEVICE

BACKGROUND OF THE INVENTION

1. Field of the Invention

The present invention relates to a key cylinder device, and particularly to a key cylinder device which is used for a vehicle luggage door or the like.

2. Description of the Related Art

Conventionally, there has been used, for a vehicle luggage door or the like, a push-button key cylinder device which is unlocked by pushing a push button. One example of this type of key cylinder device is disclosed in Japanese Utility Model Application Laid-Open No. 55-152264. The structure disclosed therein will be described hereinafter.

As shown in FIG. 16, in a key cylinder device 70, a bracket 74 is fixed to an upper portion of a cylinder case 72. A control lever 76 is swingably supported on the bracket 74 by a pin 78. A rod 80 connected to an unillustrated lock releasing mechanism is connected to the control lever 76 via a pin 82. When a push button 88 is pushed and a key rotor 84 located at a lock-releasing rotational position is moved toward the control lever 76 (i.e., in the direction indicated by arrow S in FIG. 16), the key rotor 84 is moved to a position indicated by the imaginary line in FIG. 16. For this reason, the control lever 76 rotates in a clockwise direction in FIG. 16 (the direction indicated by arrow U) by an end portion 84A of the key rotor 84 disposed on the side of the control lever 76 and is moved to a position indicated by the imaginary line in FIG. 16. As a result, the rod 80 is moved upward in Fig. 16 (i.e., in the direction indicated by arrow W) and the lock releasing mechanism is thereby adapted to operate.

A cavity 86 is formed at the end portion 84A of the key rotor 84. In a case in which the key rotor 84 is located at a locking rotational position, even if the push button 88 is pushed and the key rotor 84 is moved in the direction of arrow S in FIG. 16, an end portion 76A of the control lever 76 only penetrates into the cavity 86 and the control lever 76 is not displaced from the position indicated by the solid line in FIG. 16. For this reason, when the key rotor 84 is located at the locking rotational position, the lock releasing mechanism does not operate even if the push button 88 is pushed.

However, with this key cylinder device 70, when the cylinder case 72 is forcedly rotated downward (i.e., in the direction indicated by arrow X in FIG. 16) from the exterior of a vehicle together with the push button 88, the cylinder case 72 rotates around a point P in a vicinity of a position where it is fixed to a door panel 90. As a result, the control lever 76 rotates integrally with the cylinder case 72 in the clockwise direction in FIG. 16 (the direction of arrow U). When the control lever 76 rotates in the direction of arrow U in FIG. 16, the lock releasing mechanism may undesirably operate by movement of the rod 80 in the direction of arrow W in FIG. 16.

Meanwhile, as the prior arts related to the present invention, there are disclosed U.S. Pat. No. 3,868,836: a deck lid latch and lock assembly having a latch mechanism and a key operated lock mechanism, for operating the latch mechanism mounted, respectively, on inner and outer panels of the deck lid; and Japanese Utility Model Application Laid-Open No. 62-14064, in which a clutch is provided between an inner cylinder section of a key cylinder and a locking and lock-releasing link and an unlocking operation can be carried out by inserting a key into the key cylinder to release a tumbler and further by pushing the key therein so as to engage it with the clutch.

SUMMARY OF THE INVENTION

In view of the above-described circumstances, it is an object of the present invention to provide a key cylinder device in which, in a locked state, a lock releasing mechanism does not operate even if a cylinder case swings.

The present invention is a key cylinder device in which a locking mechanism is lock-released by depressing a push button, comprising: lever means which is mounted on a cylinder case so as to pivot with respect to the cylinder case when the push-button is depressed; and a link mechanism which moves in a direction in which the locking mechanism is lock-released only when the push button is depressed to cause the lever means to pivot with respect to the cylinder case.

In accordance with the present invention, even if the cylinder case in a locked state swings, the lever means moves integrally with the cylinder case and does not move relatively with respect thereto. Accordingly, the link mechanism does not move in the lock-releasing direction because the lever means and the link mechanism are not operatively interengaged until the lever means pivots with respect to the cylinder case when the push button is depressed. For this reason, in the locked state, even if the cylinder case swings, the lock releasing mechanism does not operate.

In this case, since the link-mechanism operating means is further provided which operates to move the link mechanism in the lock-releasing direction when the lever means moves relatively, even if the cylinder case in the locked state swings, the lever means moves integrally with the cylinder case, not relatively with respect thereto, and the link-mechanism operating means does not operate. Accordingly, the link mechanism does not move in the lock-releasing direction. As a result, in the locked state, even if the cylinder case swings, operation of the lock releasing mechanism can be reliably prevented.

DESCRIPTION OF THE PREFERRED EMBODIMENTS

[First Embodiment]

Referring now to FIGS. 1 through 6, a description will be given of a first embodiment of a key cylinder device according to the present invention.

Figure 1:
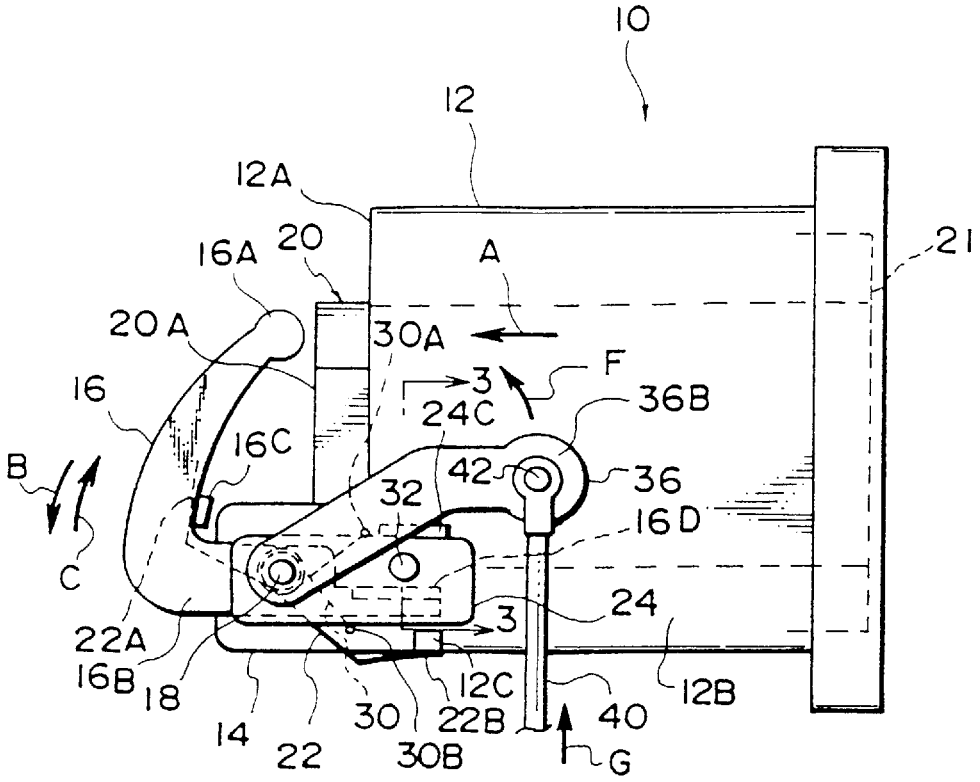
FIG. 1 is a side view showing a key cylinder device according to a first embodiment of the present invention.

As shown in FIG. 1, in a key cylinder device 10 of this embodiment, a bearing portion 14 is formed so as to project from a bottom surface 12A of a cylinder case 12 which is a side surface facing an interior of a vehicle. A first lever 16 serving as lever means is swingably supported on the bearing portion 14 by a pin 18. The first lever 16 is bent into a V-shaped configuration and an upper-side end 16A of the first lever 16 reaches near a bottom surface 20A of a key rotor 20. When a push portion 21 provided on a side surface of the cylinder case 12 facing an exterior of the vehicle is depressed, the key rotor 20 moves to the left in FIG. 1 (i.e., in the direction indicated by arrow A) and the bottom surface 20A abuts against the end 16A of the first lever 16 so as to swing the first lever 16 in a counterclockwise direction in FIG. 1 (the direction indicated by arrow B).

The pin 18 passes through a longitudinal-direction intermediate portion on a lower side 16B of the first lever 16. A spring 22 is wound around the outer periphery of the pin 18. An upper end 22A of the spring 22 is engaged with an engaging projection 16D which is formed in the vicinity and on an inner side of the bending portion of the first lever 16 so as to project toward the bearing portion 14. A lower end 22B of the spring 22 is engaged with a stopper 12C which is formed so as to project from a lower portion on a side surface 12B of the cylinder case 12. As a result, the first lever 16 is urged by the spring 22 in a clockwise direction in FIG. 1 (the direction indicated by arrow C). In a normal state, the first lever 16 is held at a position indicated in FIG. 1 in a state of abutting against the stopper 12C.

Figure 2:
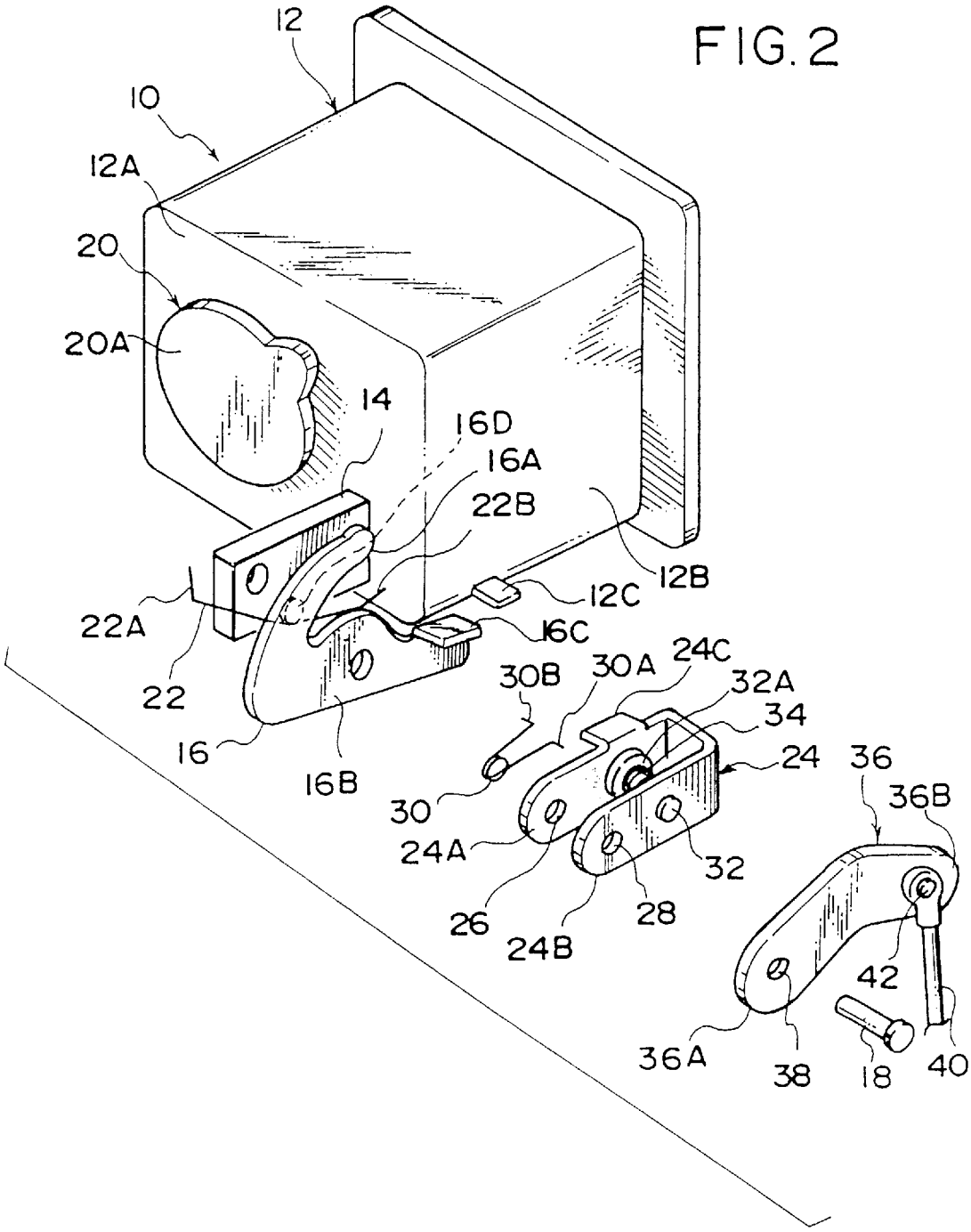
FIG. 2 is an exploded perspective view showing the key cylinder device according to the first embodiment.

As shown in FIG. 2, a second lever 24 serving as a link-mechanism operating means is disposed with the first lever 16 interposed between the bearing portion 14 and the second lever 24. The second lever 24 is also swingably supported by the pin 18. The second lever 24 is bent into a substantially U-shaped configuration when seen from a plan view and holes 26, 28 through which the pin 18 passes are formed in the second lever 24 in the vicinities of leading ends of leg portions 24A, 24B. One end 30A of a spring 30 wound around the outer periphery of the pin 18 is engaged with an upper portion of the leg portion 24A of the second lever 24, and another end 30B thereof is engaged with a lower portion in the vicinity of the leading end on the lower side 16B of the first lever 16. As a result, the second lever 24 is urged by the spring 30 in the clockwise direction in FIG. 1. In a normal state, the second lever 24 is located at a position indicated in FIG. 1 in a state of abutting against the stopper 12C.

As shown in FIG. 2, the second lever 24 includes an engaging projection 24C which is formed on the leg portion 24A near the first lever 16 so as to face the first lever 16. An engaging projection 16C of the first lever 16 is engaged with the engaging projection 24C. The engaging projection 16C is formed at a leading end of the lower side 16B of the first lever 16 so as to face the second lever 24.

Figure 3:
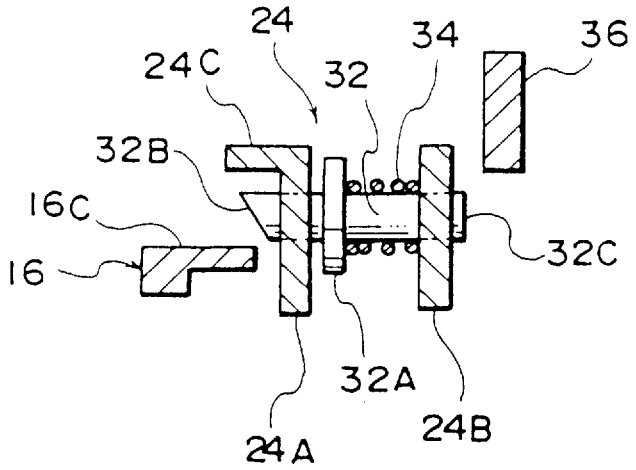
FIG. 3 is a cross-sectional view taken along the lines 3—3 in FIG. 1.

As shown in FIG. 3, a shaft 32 serving as a first shaft passes through the leg portions 24A, 24B of the second lever 24 so as to be movable in the axial direction (i.e., in the left-to-right direction in FIG. 3). A collar 32A is formed at an intermediate portion of the shaft 32. A coil spring 34 serving as urging means is interposed between the collar 32A disposed on the outer periphery of the shaft 32 and the leg portion 24B. Accordingly, the shaft 32 is held, by the urging force of the coil spring 34, at a position where the collar 32A abuts against the leg portion 24A (see FIG. 3).

In FIG. 3, an end surface 32B of the shaft 32 disposed near the first lever 16 is formed as an inclined surface. When the first lever 16 moves upward in FIG. 4 (i.e., in the direction indicated by arrow D) and slides on the end surface 32B, the shaft 32 moves to the right in FIG. 4 (i.e., in the direction indicated by arrow E) against the urging force of the coil spring 34, with the result that an opposite end portion 32C of the shaft 32 projects from the leg portion 24B. Further, when the first lever 16 rotates in the counterclockwise direction in FIG. 1 (the direction of arrow B), the engaging projection 16C of the first lever 16 is engaged with the engaging projection 24C of the second lever 24 so as to rotate the second lever 24 in the counterclockwise direction in FIG. 1 (the direction of arrow B).

As shown in FIG. 2, a third lever 36 serving as a link mechanism is disposed with the second lever 24 interposed between the first lever 16 and the third lever 36. The third lever 36 is also swingably supported by the pin 18. A hole 38 through which the pin 18 passes is formed in the vicinity of one end 36A of the third lever 36. The rod 40 connected to an unillustrated lock releasing mechanism (locking mechanism) is connected to the vicinity of another end 36B of the third lever 36 by a pin 42. When the end 36B of the third lever 36 rotates in the counterclockwise direction in FIG. 1 (the direction of arrow F) and the rod 40 is pulled up to the top side on the paper of FIG. 1 (i.e., in the direction indicated by arrow G), the lock releasing mechanism is adapted to operate.

Figure 4:
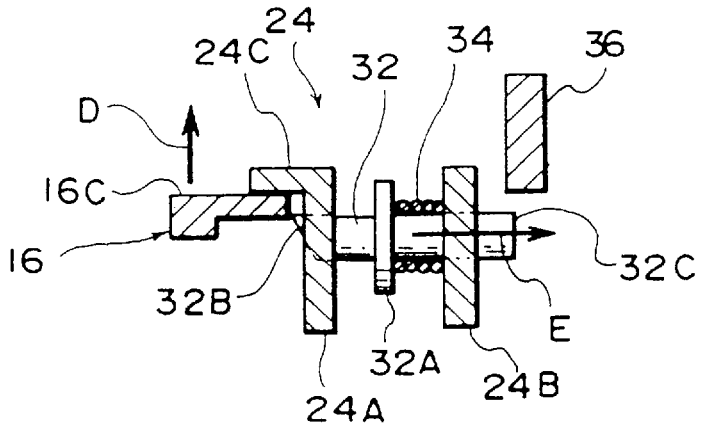
FIG. 4 is a cross-sectional view corresponding to FIG. 3, which illustrates an operation of the key cylinder device according to the first embodiment.

As shown in FIG. 4, the end portion 32C of the shaft 32 projecting from the leg portion 24B of the second lever 24 is engaged with a lower portion of the third lever 36, and the third lever 36 accordingly rotates toward the top of the paper of FIG. 4 (i.e., in the direction of arrow D), namely, in the counterclockwise direction in FIG. 1 (the direction of arrow F).

Next, an operation of the first embodiment will be described.

In the key cylinder device 10 of this embodiment, when the key rotor 20 is rotated to a lock-releasing position and the push portion 21 is depressed, the key rotor 20 moves to the left in FIG. 1 (i.e., in the direction of arrow A) and the bottom surface 20A abuts against the end 16A of the first lever 16 so as to swing the first lever 16 in the counterclockwise direction in FIG. 1 (the direction of arrow B).

When the first lever 16 moves in the direction of arrow B in FIG. 1, i.e., to the top side of the paper of FIG. 4 (in the direction of arrow D), the engaging projection 16C of the first lever 16 slides on the end surface 32B of the shaft 32 and the end portion 32C projects from the leg portion 24B. For this reason, the end portion 32C of the shaft 32 projecting from the leg portion 24B of the second lever 24 is engaged with the lower portion of the third lever 36. In this state, when the first lever 16 further rotates in the direction of arrow B in FIG. 1, the engaging projection 16C of the first lever 16 engages with the engaging projection 24C of the second lever 24 to rotate the second lever 24 in the counterclockwise direction in FIG. 1 (the direction of arrow B).

As a result, the third lever 36 rotates toward the top of the paper of FIG. 4 (i.e., in the direction of arrow D), namely, in the counterclockwise direction in FIG. 1 (the direction of arrow F), and the rod 40 accordingly moves upward in FIG. 1 (i.e., in the direction of arrow G), with the result that the lock releasing mechanism operates.

Figure 5:
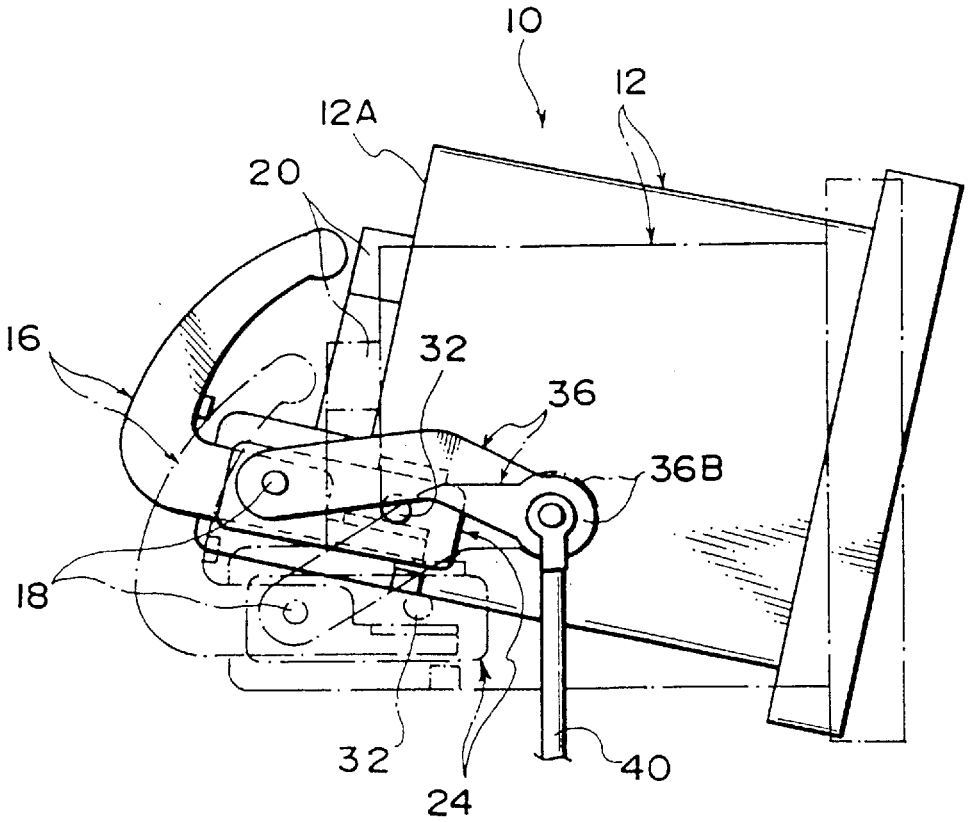
FIG. 5 is a side view corresponding to FIG. 1, which illustrates an operation of the key cylinder device according to the first embodiment.

On the other hand, as shown in FIG. 5, when, in a state in which the key rotor 20 is located at a locking position, the cylinder case 12 is forcedly swung from a normal position (indicated by the broken line in FIG. 5) to a position with the bottom surface 12A disposed on an upper side (indicated by the solid line in FIG. 5), the first lever 16 and the second lever 24 also swing integrally with the cylinder case 12. However, since the cylinder case 12, the first lever 16 and the second lever 24 do not move relatively, the shaft 32 does not move and is held at the position shown in FIG. 3. Accordingly, the third lever 36 does not interfere with the shaft 32 and can rotate with respect to the pin 18, so that the end 36B hardly moves. For this reason, the rod 40 attached to the end 36B does not move in a direction in which locking is released (the direction of arrow G in FIG. 1) and the lock releasing mechanism does not operate accordingly.

Figure 6:
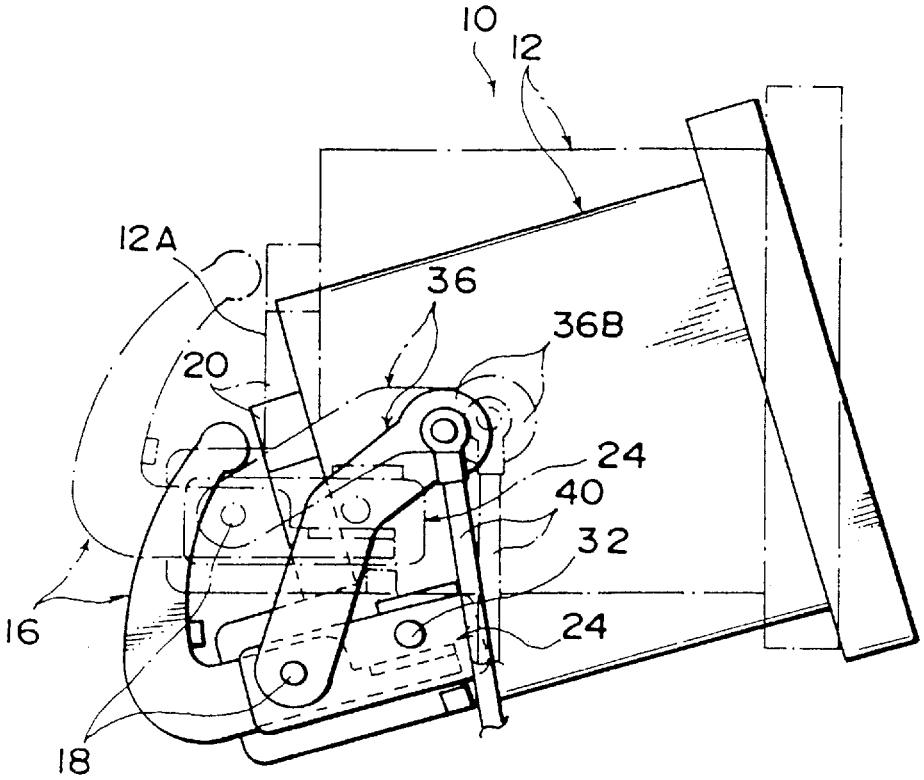
FIG. 6 is a side view corresponding to FIG. 1, which illustrates an operation of the key cylinder device according to the first embodiment.

As shown in FIG. 6, when, in the state in which the key rotor 20 is located at the locking position, when the cylinder case 12 is forcedly swung from a normal position (indicated by the broken line in FIG. 6) to a position with the bottom surface 12A disposed on a lower side (indicated by the solid line in FIG. 6), the first lever 16 and the second lever 24 also swing integrally with the cylinder case 12. However, since the cylinder case 12, the first lever 16 and the second lever 24 do not move relatively, the shaft 32 does not move and is held at the position shown in FIG. 3. Accordingly, the third lever 36 does not interfere with the shaft 32 and can rotate with respect to the pin 18, so that the end 36B hardly moves. For this reason, the rod 40 attached to the end portion 36B does not move in the lock-releasing direction (the direction of arrow G in FIG. 1) and the lock releasing mechanism does not operate accordingly.

As described above, with the key cylinder device 10 according to this embodiment, even if the cylinder case swings in the locked state, the lock releasing mechanism does not operate. Accordingly, the above-described device is effective in preventing burglary.

[Second embodiment]

A second embodiment of a key cylinder device according to the present invention will be hereinafter described with reference to FIGS. 7 through 11. It should be noted that the same members as those of the first embodiment will be denoted by the same reference numerals, and a description thereof will be omitted.

Figure 7:
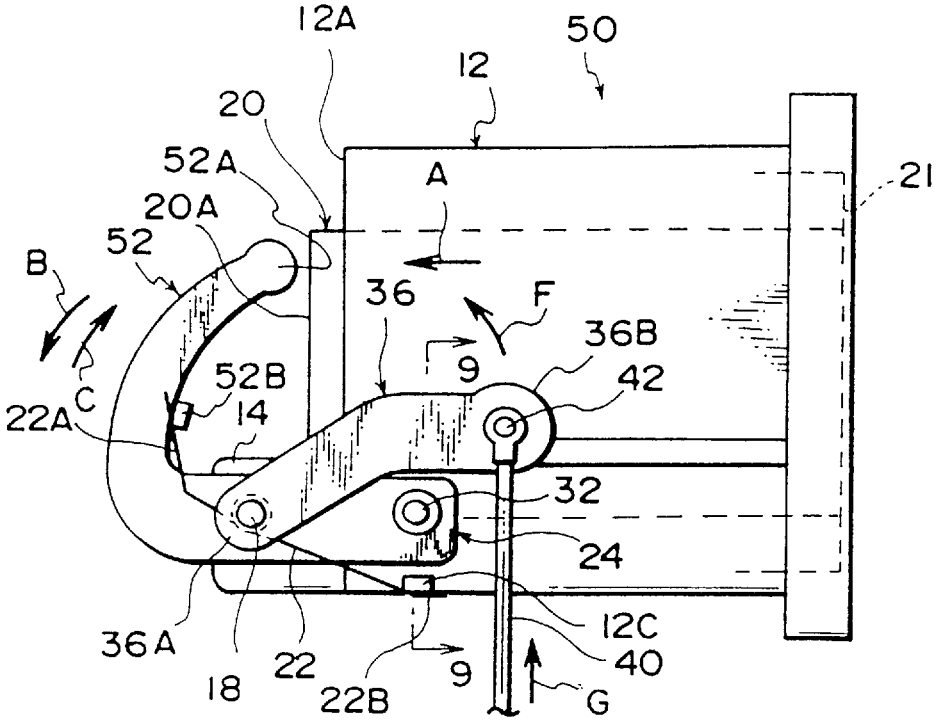
FIG. 7 is a side view showing a key cylinder device according to a second embodiment of the present invention.
Figure 8:
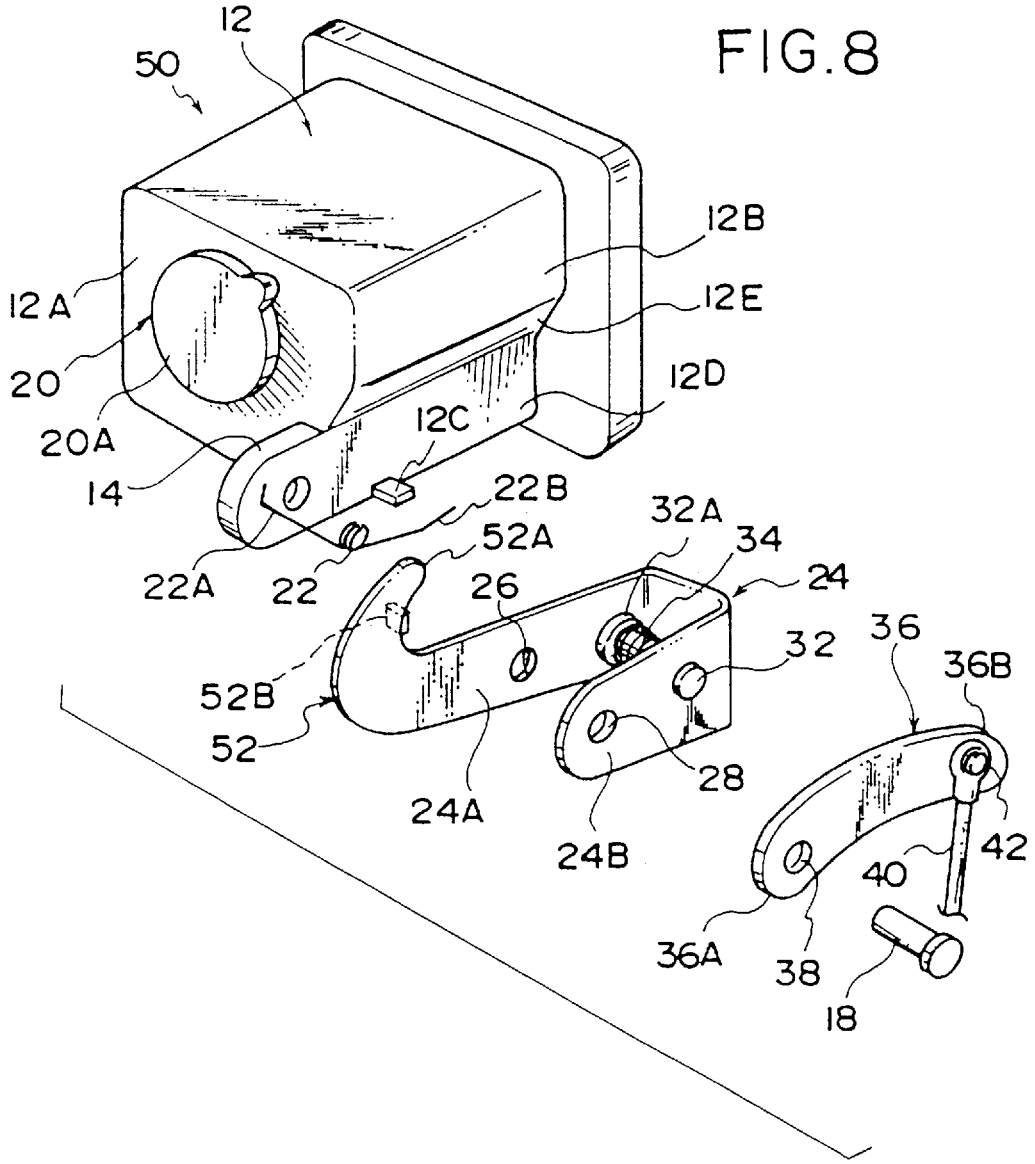
FIG. 8 is an exploded perspective view showing the key cylinder device according to the second embodiment.

As shown in FIG. 8, in a key cylinder device 50 of the second embodiment, a lever portion 52 is used in place of the first lever 16 of the first embodiment. The lever portion 52 is formed by extending a distal end of the leg portion 24A of the second lever 24 into a substantially J-shaped configuration and an upper end 52A of the lever portion 52 reaches near the bottom surface 20A of the key rotor 20. The upper end 22A of the spring 22 is engaged with an engaging projection 52B which is formed in the lever portion 52 so as to project toward the bearing portion 14. The lower end 22B of the spring 22 is engaged with a stopper 12C formed in the cylinder case 12. As a result, the second lever 24 having the lever portion 52 is urged by the spring 22 to rotate in a clockwise direction in FIG. 7 (the direction indicated by arrow C). In a normal state, the second lever 24 abuts against the stopper 12C and is located at a normal position indicated in FIG. 7.

Figure 9:
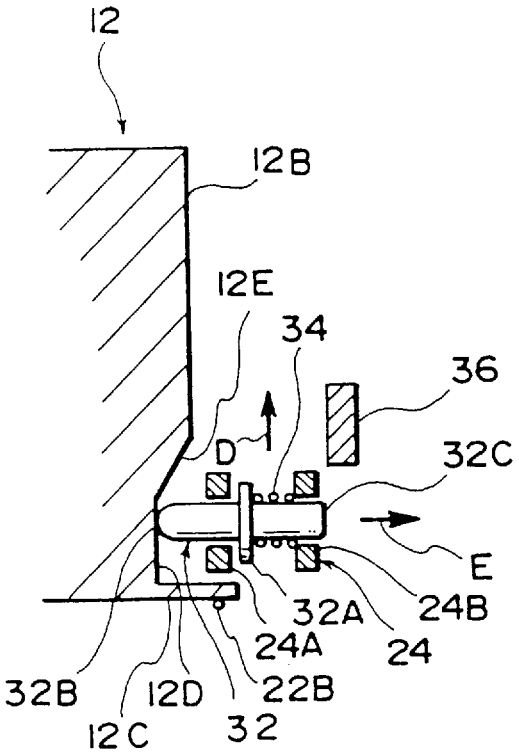
FIG. 9 is a cross-sectional view taken along the lines 9—9 in FIG. 7.

As shown in FIG. 9, a concave portion 12D is formed on the side surface 12B of the cylinder case 12 at a lower portion thereof and an inclined surface 12E is formed at an upper portion of the concave portion 12D. An end surface 32B of the shaft 32 is formed as a hemispherical surface.

Accordingly, when the second lever 24 moves upward in FIG. 9 (i.e., in the direction indicated by arrow D) and the end surface 32B of the shaft 32 slides on the inclined surface 12E, the shaft 32 moves to the right in FIG. 9 (i.e., in the direction indicated by arrow E), with the result that an opposite end 32C of the shaft projects from the leg portion 24B. As a result, the third lever 36 rotates, together with the second lever 24, toward the top of the paper of FIG. 9 (in the direction of arrow D), i.e., in a counterclockwise direction in FIG. 7 (the direction indicated by arrow F), and the rod 40 is pulled up toward the top of the paper of FIG. 1 (in the direction of arrow G) so as to actuate the lock releasing mechanism.

Next, an operation of the second embodiment will be described.

In the key cylinder device 50 of this embodiment, when the key rotor 20 is rotated to the lock-releasing position and the push portion 21 is depressed, the key rotor 20 moves to the left in FIG. 7 (in the direction indicated by arrow A) and the bottom surface 20A abuts against the end 52A of the lever portion 52 to swing the second lever 24 in the counterclockwise direction in FIG. 7 (the direction of arrow B).

When the second lever 24 moves in the direction of arrow B in FIG. 7, i.e., to the top side of the paper of FIG. 9 (the direction of arrow D), the end surface 32B of the pin 32 slides on the inclined surface 12E of the cylinder case 12, with the result that the end portion 32C projects from the leg portion 24B. For this reason, the end portion 32C of the shaft 32 projecting from the leg portion 24B of the second lever 24 is engaged with the lower portion of the third lever 36. When, in this state, the second lever 24 further rotates in the direction of arrow B in FIG. 7, the third lever 36 rotates toward the top side of the paper of FIG. 9 (in the direction of arrow D), namely, in the counterclockwise direction in FIG. 7 (the direction of arrow F), and the rod 40 moves upward in FIG. 7 (in the direction of arrow G), with the result that the lock releasing mechanism operates.

Figure 10:
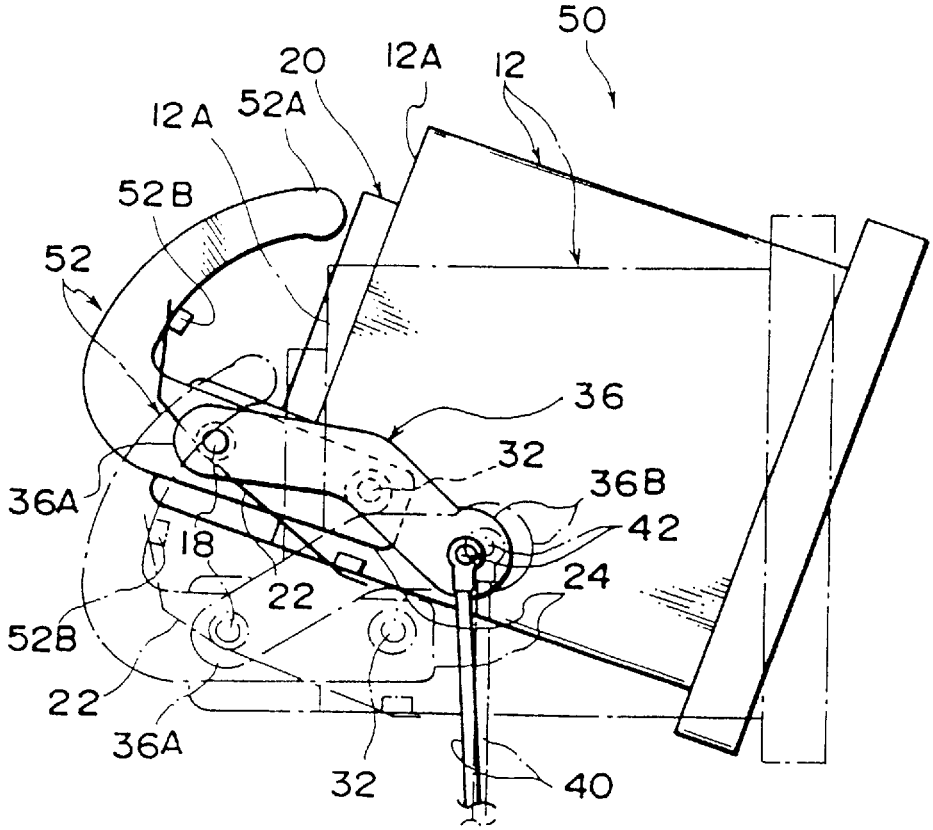
FIG. 10 is a side view corresponding to FIG. 7, which illustrates an operation of the key cylinder device according to the second embodiment.

On the other hand, as shown in FIG. 10, when, in the state in which the key rotor 20 is located at the locking position, the cylinder case 12 is forcedly swung from a normal position (indicated by the broken line in FIG. 10) to a position with the bottom surface 12A disposed on an upper side (indicated by the solid line in FIG. 10), the second lever 24 also swings integrally with the cylinder case 12. However, since the cylinder case 12 and the second lever 24 do not move relatively, the shaft 32 does not move and is held at the position shown in FIG. 9. Accordingly, the third lever 36 does not interfere with the shaft 32 and can rotate with respect to the pin 18, so that the end portion 36B hardly moves. For this reason, the rod 40 attached to the end portion 36B does not move in the lock-releasing direction (the direction of arrow G in FIG. 7) and the lock releasing mechanism does not operate accordingly.

Figure 11:
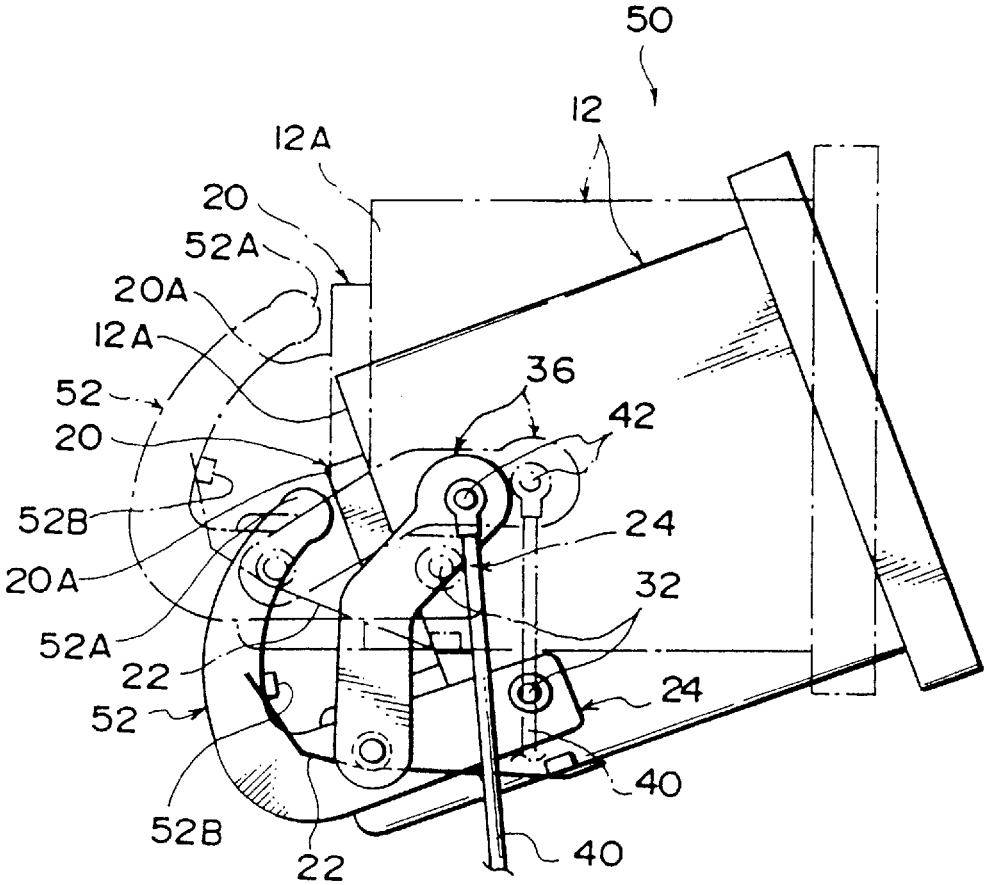
FIG. 11 is a side view corresponding to FIG. 7, which illustrates an operation of the key cylinder device according to the second embodiment.

Further, as shown in FIG. 11, when, in the state in which the key rotor 20 is located at the locking position, the cylinder case 12 is forcedly swung from a normal position (indicated by the broken line in FIG. 11) to a position with the bottom surface 12A disposed on a lower side (indicated by the solid line in FIG. 11), the second lever 24 also swings integrally with the cylinder case 12. However, since the cylinder case 12 and the second lever 24 do not move relatively, the shaft 32 does not move and is held at the position shown in FIG. 9. Accordingly, the third lever 36 does not interfere with the shaft 32 and can rotate with respect to the pin 18, so that the end portion 36B hardly moves. For this reason, the rod 40 attached to the end portion 36B does not move in the lock-releasing direction (the direction of arrow G in FIG. 7) and the lock releasing mechanism does not operate accordingly.

As described above, with the key cylinder 50 of this embodiment, even if the cylinder case swings in a locked state, the lock releasing mechanism does not operate. Accordingly, the above-described device is effective in preventing burglary. In addition, the number of parts is reduced and a structure of the device becomes simple.

[Third Embodiment]

A third embodiment of a key cylinder device according to the present invention will be hereinafter described with reference to FIGS. 12 through 15. It should be noted that the same members as those of the first embodiment will be denoted by the same reference numerals, and a description thereof will be omitted.

Figure 13:
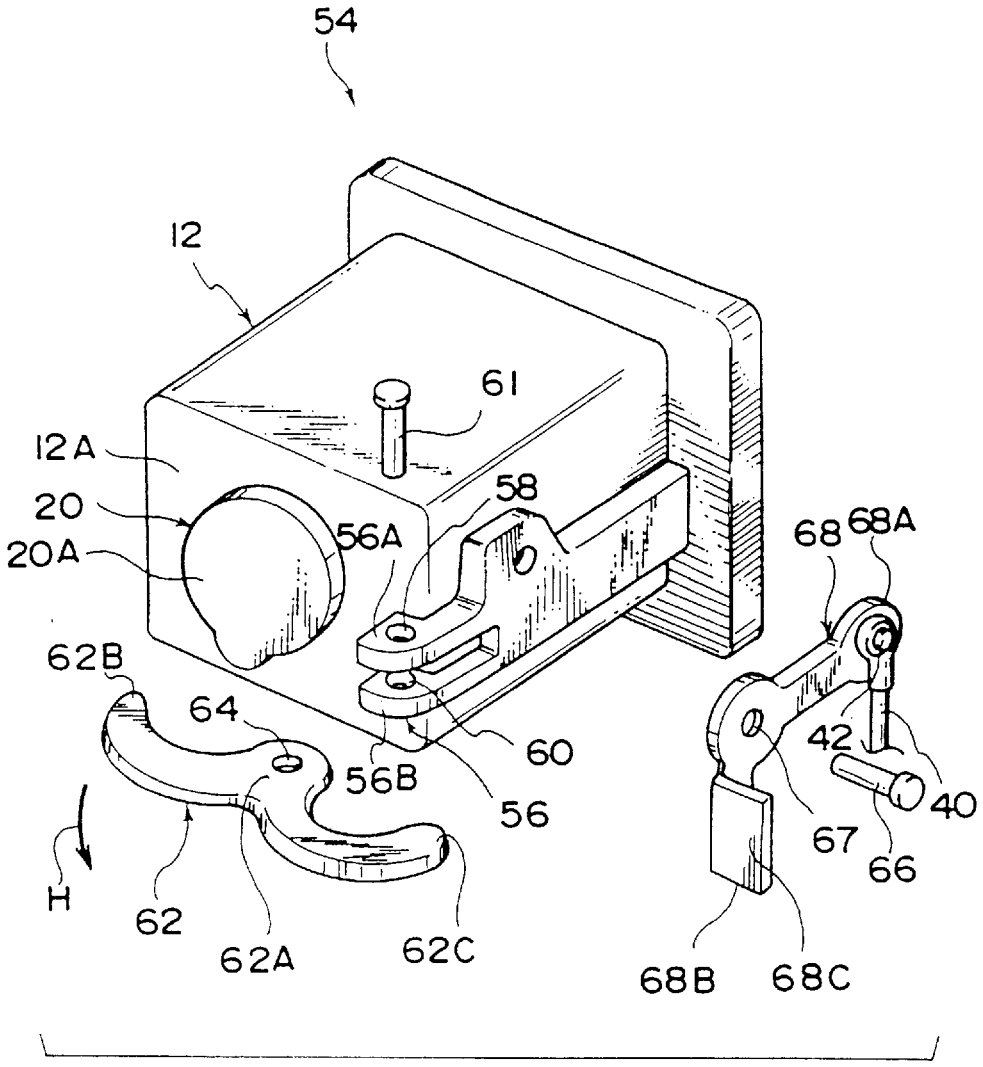
FIG. 13 is an exploded perspective view showing the key cylinder device according to the third embodiment.

As shown in FIG. 13, in a key cylinder device 54 of the third embodiment, a bearing portion 56 is formed so as to project from the bottom surface 12A of the cylinder case 12. The bearing portion 56 is formed by an upper bearing portion 56A and a lower bearing portion 56B, which are disposed parallel with each other in a vertical direction when seen from the plane of FIG. 13. Through holes 58, 60 are formed in the upper bearing portion 56A and the lower bearing portion 56B, respectively, and a pin 61 serving as a second shaft is inserted into these through holes 58, 60. A lever 62 is inserted between the upper bearing portion 56A and the lower bearing portion 56B and is swingably supported by the pin 61.

The lever 62 is curved into the shape of the FIG. "3" and a hole 64 through which the pin 61 passes is formed at an intermediate portion 62A of the lever 62. One end 62B of the lever 62 reaches near the bottom surface 20A of the key rotor 20. When the push portion 21 shown in FIG. 12 is depressed, the key rotor 20 moves to the left in FIG. 12 (i.e., in the direction indicated by arrow A) and abuts against the end 62B of the lever 62 to swing the lever 62 around the pin 61 in the direction indicated by arrow H in FIG. 13.

Figure 12:
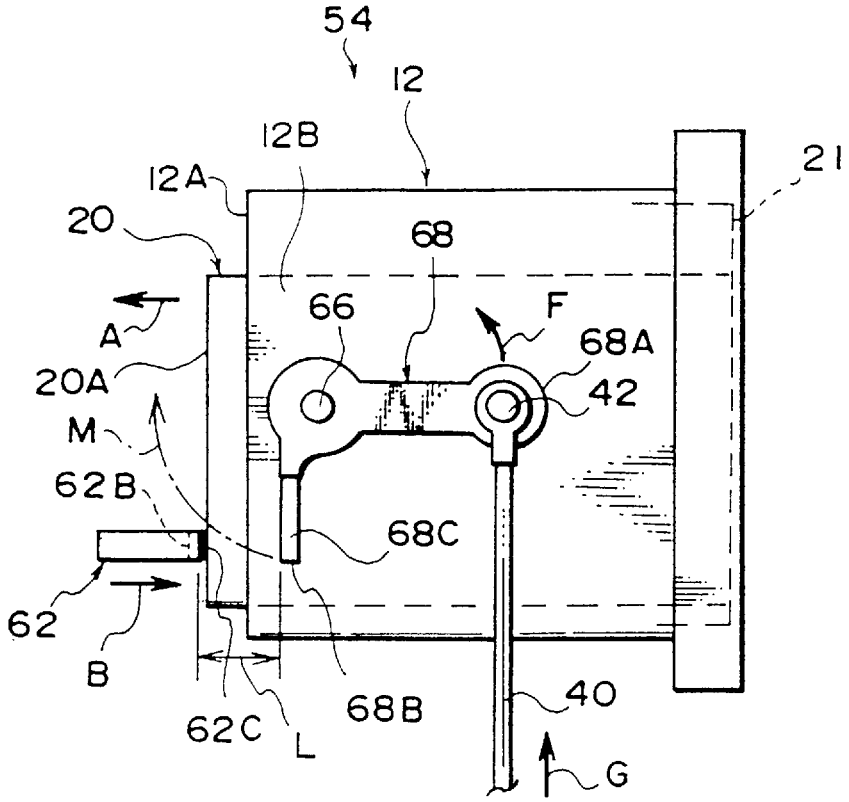
FIG. 12 is a side view showing a key cylinder device according to a third embodiment of the present invention.

As shown in FIG. 12, a pin 66 serving as a third shaft is provided upright on the side surface 12B of the cylinder case 12. A lever 68 which forms a link mechanism is swingably supported by the pin 66. The lever 68 is bent into an L-shaped configuration and a hole 67 (see FIG. 13) through which the pin 66 passes is formed at a bending portion of the lever 68. The rod 40 connected to an unillustrated lock releasing mechanism is connected by the pin 42 to the vicinity of one end 68A of the lever 68. When the end 68A of the lever 68 rotates in a counterclockwise direction in FIG. 12 (the direction indicated by arrow F) and the rod 40 is pulled up toward the top side of the paper of FIG. 12 (i.e., in the direction indicated by arrow G), the lock releasing mechanism is thereby adapted to operate.

As shown in FIG. 13, an engaging projection 68C serving as an interference surface is formed in the vicinity of another end 68B of the lever 68 so as to face an opposite side of the cylinder case 12. When another end 62C of the lever 62 abuts against the engaging projection 68C, the lever 68 is adapted to swing in the direction indicated by arrow F in FIG. 12. Meanwhile, when the end 62C of the lever 62 is not moving relatively with respect to the cylinder case 12, the end 62C is located at a normal position separated from the engaging projection 68C of the lever 68 by a predetermined distance L. This normal position is set such that the end 62C of the lever 62 does not interfere with a locus of rotation of the engaging projection 68C of the lever 68 (indicated by the dashed-line arrow M in FIG. 12).

Next, an operation of the third embodiment will be described.

In the key cylinder device 54 of this embodiment, when the key rotor 20 is rotated to the lock-releasing position and the push portion 21 is depressed, the key rotor 20 moves to the left in FIG. 12 (i.e., in the direction indicated by arrow A) and abuts against the end 62B of the lever 62 to swing the lever 62 around the pin 61 in the direction indicated by arrow H in FIG. 13.

When the lever 62 moves in the direction of arrow H in FIG. 13, i.e, to the right in FIG. 12 (in the direction of arrow B), the end 62C of the lever 62 abuts against the engaging projection 68C of the lever 68 to rotate the lever 68 in the counterclockwise direction in FIG. 12 (the direction of arrow F), and the rod 40 is moved upward in FIG. 12 (in the direction of arrow G), with the result that the lock releasing mechanism operates.

Figure 14:
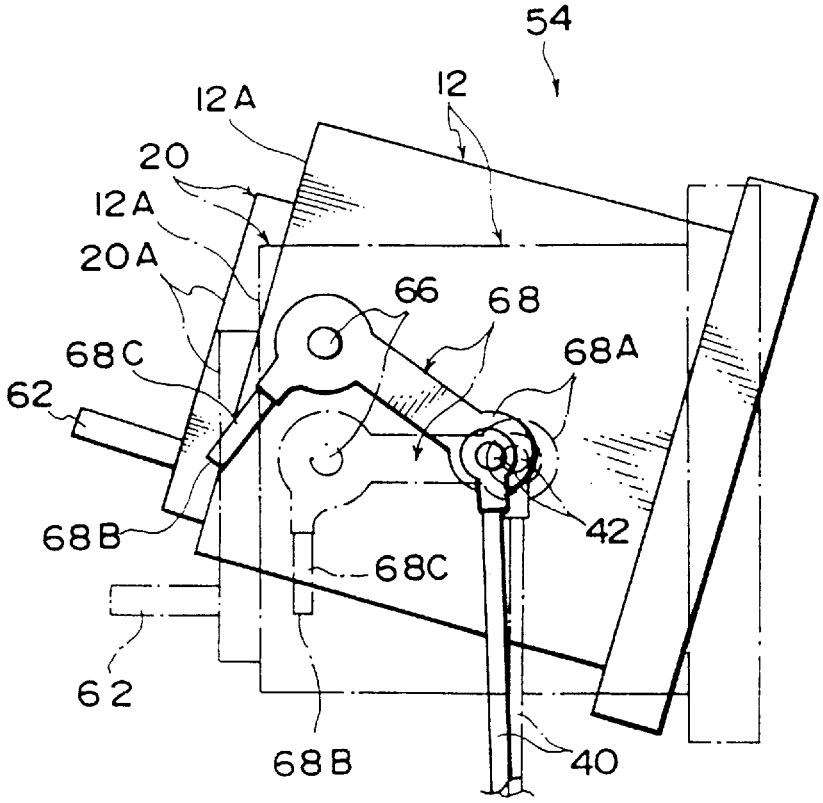
FIG. 14 is a side view corresponding to FIG. 12, which illustrates an operation of the key cylinder device according to the third embodiment.

On the other hand, as shown in FIG. 14, when, in a state in which the key rotor 20 is located at the locking position, the cylinder case 12 is forcedly swung from a normal position (indicated by the broken line in FIG. 14) to a position with the bottom surface 12A disposed on an upper side (indicated by the solid line in FIG. 14), the lever 62 swings integrally with the cylinder case 12. However, the cylinder case 12 and the lever 62 does not move relatively. Namely, the lever 62 does not swing around the pin 61 and is held at the normal position indicated in FIG. 14. For this reason, even if the engaging projection 68C of the lever 68 rotates, the end 62C of the lever 62 and the engaging projection 68C do not interfere with each other.

Accordingly, the end 68A of the lever 68 hardly moves. For this reason, the rod 40 attached to the end 68A does not move in the lock-releasing direction (the direction of arrow G in FIG. 12) and the lock releasing mechanism does not operate accordingly.

Figure 15:
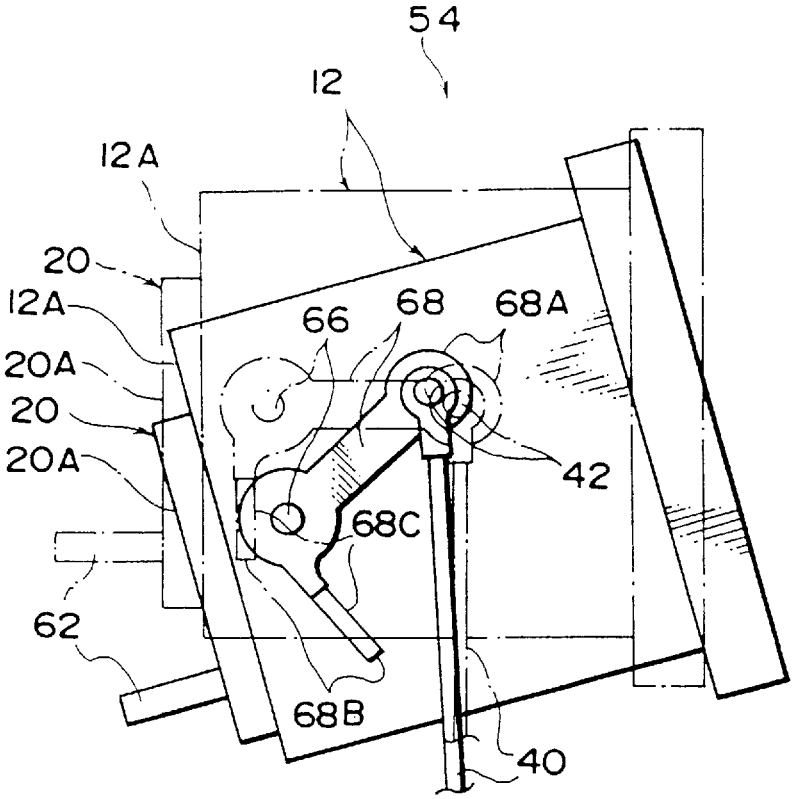
FIG. 15 is a side view corresponding to FIG. 12, which illustrates an operation of the key cylinder device according to the third embodiment.
Figure 16:
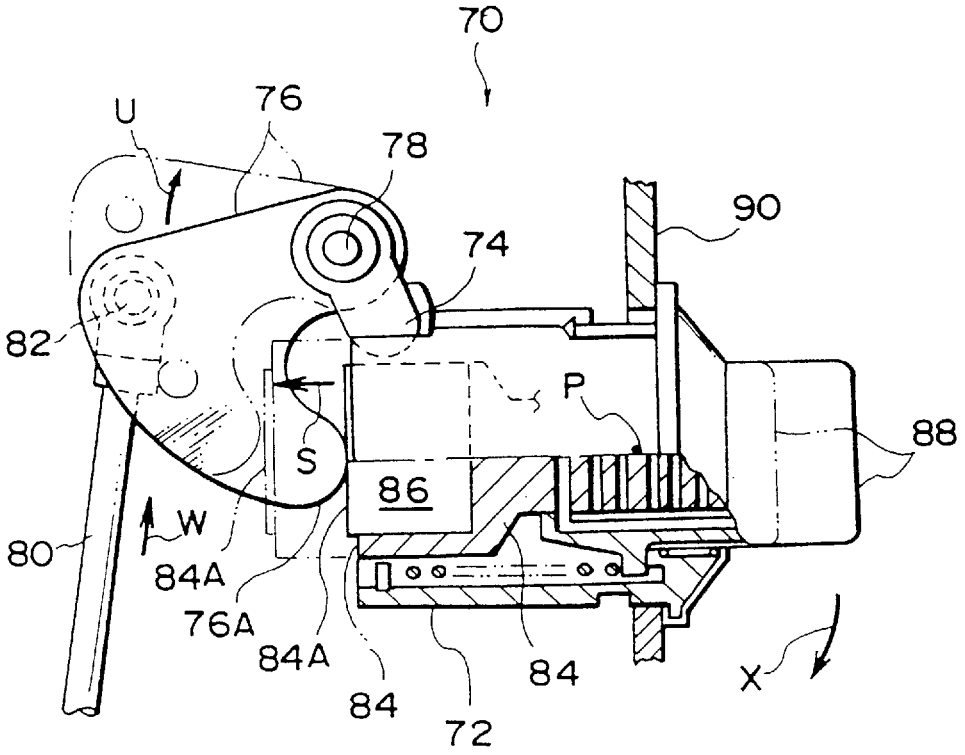
FIG. 16 PRIOR ART
FIG. 16 is a partially-broken side view showing a conventional key cylinder device.

As shown in FIG. 15, when, in a state in which the key rotor 20 is located at the locking position, the cylinder case 12 is forcedly swung from a normal position (indicated by the broken line in FIG. 15) to a position with the bottom surface 12A disposed on a lower side (indicated by the solid line in FIG. 15), the lever 62 swings integrally with the cylinder case 12. However, the cylinder case 12 and the lever 62 do not move relatively. Namely, the lever 62 does not swing around the pin 61 and is located at the normal position indicated in FIG. 15. For this reason, even if the engaging projection 68C of the lever 68 rotates, the end 62C of the lever 62 and the engaging projection 68C do not interfere with each other.

Accordingly, the end 68A of the lever 68 hardly moves. For this reason, the rod 40 attached to the end 68A does not move in the lock-releasing direction (the direction indicated by arrow G in FIG. 12) and the lock releasing mechanism does not operate accordingly.

As described above, the key cylinder device 54 of this embodiment is constructed in that, in a locked state, the lock releasing mechanism does not operate even if the cylinder case swings. This is effective in preventing burglary. In addition, the number of parts is reduced and the structure of the device becomes simple.

What is claimed is:

1. A key cylinder device in which a locking mechanism is lock-released by depressing a push button, comprising:

lever means pivotally mounted on a cylinder case such that when the push button is depressed, said lever means pivots with respect to the cylinder case; and a link mechanism which moves in a direction in which the locking mechanism is lock-released only when the push button is depressed to cause said lever means to pivot with respect to the cylinder case, wherein said lever means and said link mechanism are not operatively interengaged prior to said lever means pivoting with respect to the cylinder case when the push button is depressed.

2. A key cylinder device according to claim 1, wherein said lever means is swingably mounted on the cylinder case.

3. A key cylinder device according to claim 1, wherein, when the cylinder case swings in a state in which the locking mechanism is locked, said lever means swings integrally with the cylinder case.

4. A key cylinder device according to claim 1, further comprising:

link-mechanism operating means which, when said lever means pivots with respect to the cylinder case, actuates and moves said link mechanism in the direction in which the locking mechanism is lock-released.

5. A key cylinder device according to claim 4, wherein, when said lever means pivots with respect to the cylinder case, said lever means can move to a position where it interferes with said link-mechanism operating means.

6. A key cylinder device according to claim 4, wherein said link-mechanism operating means has a first axis which, when said lever means pivots with respect to the cylinder case, extends into and engages with said link mechanism.

7. A key cylinder device according to claim 6, wherein the first axis moves said link mechanism in the direction in which the locking mechanism is lock-released by extending into and engaging with said link mechanism.

8. A key cylinder device according to claim 7, wherein an end surface of the first axis, which is disposed on an opposite side of the end extending into and engaging with said link mechanism, slides on said lever means when said lever means pivots with respect to the cylinder case.

9. A key cylinder device according to claim 8, wherein the end surface of the first axis is formed as an inclined surface which is inclined to a direction perpendicular to a direction in which the first axis extends into and engages with said link mechanism.

10. A key cylinder device according to claim 8, wherein said link-mechanism operating means includes urging means which, when the locking mechanism is locked, urges the first axis in a direction opposite to the direction in which the first axis extends into and engages with said link mechanism so as to prevent the first axis from extending into and engaging with said link mechanism.

11. A key cylinder device according to claim 10, wherein the first axis extends to engage with said link mechanism against an urging force of the urging means while sliding on said lever means.

12. A key cylinder device according to claim 4, wherein said lever means, said link mechanism and said link-mechanism operating means are supported on the same axial line so as to be swingable respectively.

13. A key cylinder device according to claim 7, wherein the end surface of the first axis, which is disposed on an opposite side of an end extending into and engaging with said link mechanism, is formed as a substantially hemispherical surface and when said lever means pivots with respect to the cylinder casing, the end surface of the first axis slides on the cylinder case.

14. A key cylinder device according to claim 13, wherein an inclined surface is formed in the cylinder case at a portion on which the end surface of the first axis slides, the inclined surface being inclined to a direction perpendicular to the direction in which the first axis extends into and engages with said link mechanism, and when said lever means pivots with respect to the cylinder casing, the end surface of the first axis slides on the inclined surface of the cylinder case.

15. A key cylinder device according to claim 13, wherein said link-mechanism operating means includes urging means which, when the locking mechanism is locked, urges the first axis in a direction opposite to the direction in which the first axis extends into and engages with said link mechanism so as to prevent the first axis from extending into and engaging with said link mechanism.

16. A key cylinder device according to claim 15, wherein the first axis extends to engage with said link mechanism against an urging force of the urging means while sliding on said lever means.

17. A key cylinder device according to claim 7, wherein said lever means and said link-mechanism operating means are formed integrally with each other.

18. A key cylinder device according to claim 1, further comprising:

a bearing portion formed in the cylinder case, wherein said lever means is supported by a first shaft fitted into said bearing portion so as to be pivotal with respect to the cylinder casing and said link mechanism is swingably supported by a second shaft which is axially retained at said bearing portion.

19. A key cylinder device according to claim 18, wherein said first shaft and said second shaft are disposed perpendicular to each other.

20. A key cylinder device according to claim 18, wherein said link mechanism includes an interference surface which interferes with said lever means when said lever means pivots with respect to the cylinder casing.

* * * * *